US009400137B2

(12) United States Patent
Prabhu et al.

(10) Patent No.: US 9,400,137 B2
(45) Date of Patent: Jul. 26, 2016

(54) ELECTRIC INDUCTION FURNACE WITH LINING WEAR DETECTION SYSTEM

(75) Inventors: Satyen N. Prabhu, Voorhees, NJ (US); Thomas W. Shorter, Hainesport, NJ (US)

(73) Assignee: INDUCTOTHERM CORP., Rancocas, NJ (US)

( * ) Notice: Subject to any disclaimer, the term of this patent is extended or adjusted under 35 U.S.C. 154(b) by 766 days.

(21) Appl. No.: 13/478,690

(22) Filed: May 23, 2012

(65) Prior Publication Data

US 2012/0300806 A1 Nov. 29, 2012

Related U.S. Application Data

(60) Provisional application No. 61/497,787, filed on Jun. 16, 2011, provisional application No. 61/488,866, filed on May 23, 2011.

(51) Int. Cl.

| | |
|---|---|
| ***H05B 6/06*** | (2006.01) |
| ***H01R 43/00*** | (2006.01) |
| ***F27D 1/16*** | (2006.01) |
| ***B22D 1/00*** | (2006.01) |
| ***F27B 14/06*** | (2006.01) |
| ***F27D 21/00*** | (2006.01) |
| ***F27B 14/20*** | (2006.01) |
| ***H05B 6/24*** | (2006.01) |

(52) U.S. Cl.

CPC ..... *F27B 14/061* (2013.01); *F27B 14/20* (2013.01); *F27D 21/0021* (2013.01); *H05B 6/24* (2013.01); *Y10T 29/49117* (2015.01)

(58) Field of Classification Search

CPC .... F27B 14/061; F27B 14/20; F27D 21/0021; H05B 6/24

USPC ..... 164/135, 335; 373/145, 148, 149, 151, 373/155, 156; 264/60, 220, 250; 29/825

See application file for complete search history.

(56) References Cited

U.S. PATENT DOCUMENTS

| | | | | |
|---|---|---|---|---|
| 3,401,227 | A * | 9/1968 | Dunlevy et al. | 373/155 |
| 4,248,809 | A | 2/1981 | Sakai et al. | |
| 4,675,879 | A * | 6/1987 | Meredith | 373/155 |
| 5,319,671 | A | 6/1994 | Hopf | |
| 5,416,795 | A * | 5/1995 | Kaniuk et al. | 373/155 |
| 5,781,581 | A * | 7/1998 | Fishman et al. | 373/152 |
| 6,148,018 | A * | 11/2000 | Garcia et al. | 373/145 |
| 2003/0213575 | A1 * | 11/2003 | Todaro et al. | 164/135 |
| 2004/0114663 | A1 | 6/2004 | Mueller et al. | |

FOREIGN PATENT DOCUMENTS

| | | |
|---|---|---|
| JP | 02-298853 A | 12/1990 |
| JP | 5-180583 A | 7/1993 |

* cited by examiner

*Primary Examiner* — Dana Ross
*Assistant Examiner* — Ket D Dang
(74) *Attorney, Agent, or Firm* — Philip O. Post

(57) ABSTRACT

An electric induction furnace for heating and melting electrically conductive materials is provided with a lining wear detection system that can detect replaceable furnace lining wear when the furnace is properly operated and maintained.

19 Claims, 14 Drawing Sheets

ELECTRIC INDUCTION FURNACE WITH LINING WEAR DETECTION SYSTEM

CROSS REFERENCE TO RELATED APPLICATIONS

This application claims the benefit of U.S. Provisional Application No. 61/488,866 filed May 23, 2011 and U.S. Provisional Application No. 61/497,787 filed Jun. 16, 2011, both of which are hereby incorporated by reference in their entireties.

FIELD OF THE INVENTION

The present invention relates to electric induction furnaces, and in particular, to detecting furnace lining wear in induction furnaces.

BACKGROUND OF THE INVENTION

FIG. 1 illustrates components of a typical electric induction furnace relevant to a replaceable refractory lining used in the furnace. Replaceable lining 12 (shown stippled in the figure) consists of a material with a high melting point that is used to line the inside walls of the furnace and form interior furnace volume 14. A metal or other electrically conductive material is placed within volume 14 and is heated and melted by electric induction. Induction coil 16 surrounds at least a portion of the exterior height of the furnace and an alternating current flowing through the coil creates a magnetic flux that couples with the material placed in volume 14 to inductively heat and melt the material. Furnace foundation 18 is formed from a suitable material such as refractory bricks or cast blocks. Coil 16 can be embedded in a trowelable refractory (grout) material 20 that serves as thermal insulation and protective material for the coil. A typical furnace ground leak detector system includes probe wires 22*a* protruding into melt volume 14 through the bottom of lining 12 as illustrated by wire end 22*a*' protruding into the melt volume. Wires 22*a* are connected to electrical ground lead 22*b*, which is connected to a furnace electrical ground (GND). Wires 22*a*, or other arrangements used in a furnace ground leak detector system may be generally referred to herein as a ground probe.

As the furnace is used for repeated melts within volume 14, lining 12 is gradually consumed. Lining 12 is replenished in a furnace relining process after a point in the service life of the furnace. Although it is contrary to safe furnace operation and disregards the recommendation of the refractory manufacturer and installer, an operator of the furnace may independently decide to delay relining until refractory lining 12 between the molten metal inside furnace volume 14 and coil 16 has deteriorated to the state that furnace coil 16 is damaged and requires repair, and/or foundation 18 has been damaged and requires repair. In such event, the furnace relining process becomes extensive.

U.S. Pat. No. 7,090,801 discloses a monitoring device for melting furnaces that includes a closed circuit consisting of several conductor sections with at least a partially conducting surface and a measuring/displaying device. A comb-shaped first conductor section is series connected through an ohmic resistor R to a second conductor section. The comb-shaped first conductor section is mounted on the refractory lining and arranged directly adjacent, however, electrically isolated from, the second conductor section.

U.S. Pat. No. 6,148,018 discloses an induction melting furnace that includes a detection system for sensing metal penetration into a wall of the furnace depending upon detecting heat flow from the hearth to the furnace. An electrode system is interposed between the induction coil and a slip plane material that serves as a backing to the refractory lining. The electrode system comprises a sensing mat housing conductors receiving a test signal from the power supply, wherein the sensing mat includes a temperature sensitive binder that varies conductivity between the conductors in response to heat penetration through the lining.

U.S. Pat. No. 6,148,018 discloses an induction melting furnace that includes a detection system for sensing metal penetration into a wall of the furnace depending upon detecting heat flow from the hearth to the furnace. An electrode system is interposed between the induction coil and a slip plane material that serves as a backing to the refractory lining. The electrode system comprises a sensing mat housing conductors receiving a test signal from the power supply, wherein the sensing mat includes a temperature sensitive binder that varies conductivity between the conductors in response to heat penetration through the lining.

U.S. Pat. No. 1,922,029 discloses a shield that is inserted in the furnace lining to form one contact of a control circuit. The shield is made of sheet metal and is bent to form a cylinder. When metal leaks out from the interior of furnace it makes contact with the shield, and the signal circuit is closed.

U.S. Pat. No. 1,823,873 discloses a ground shield that is located within the furnace lining and spaced apart from the induction coil. An upper metallic conduit of substantially open annular shape is provided, as is also a similar lower metal conduit also of open annular shape. A plurality of relatively smaller metallic pipes or conduits extend between the two larger conduits and are secured thereto in a fluid-tight manner. A ground is provided which is connected to the protecting shield.

One object of the present invention is to provide an electric induction furnace with a lining wear detection system that can assist in avoiding furnace coil damage and/or bottom foundation damage due to lining wear when the furnace is properly operated and maintained.

BRIEF SUMMARY OF THE INVENTION

In one aspect, the present invention is an apparatus for, and method of providing a lining wear detection system for an electric induction furnace.

In another aspect the present invention is an electric induction furnace with a lining wear detection system. A replaceable furnace lining has an inner boundary surface and an outer boundary surface, with the inner boundary surface forming the interior volume of the electric induction furnace in which electrically conductive material can be deposited for induction heating and melting. At least one induction coil surrounds the exterior height of the replaceable lining. A furnace ground circuit has a first end at a ground probe, or probes, protruding into the interior volume of the electric induction furnace and a second end at an electrical ground connection external to the electric induction furnace. At least one electrically conductive mesh is embedded in a castable refractory disposed between the outer boundary surface of the wall of the replaceable lining and the induction coil. Each electrically conductive mesh forms an electrically discontinuous mesh boundary between the castable refractory in which it is embedded and the replaceable lining. A direct current voltage source has a positive electric potential connected to the electrically conductive mesh, and a negative electric potential connected to the electrical ground connection. A lining wear detection circuit is formed from the positive electric potential connected to the electrically conductive mesh to the negative electric potential connected to the electrical ground connection so that the level of DC leakage current in the lining wear detection circuit changes as the wall of the replaceable lining is consumed. A detector can be connected to each one of the lining wear detection circuits for each electrically conductive mesh to detect the change in the level of DC leakage current, or alternatively a single detector can be switchably connected to multiple lining wear detection circuits.

In another aspect the present invention is a method of fabricating an electric induction furnace with a lining wear detection system. A wound induction coil is located above a foundation and a refractory can be installed around the wound induction coil to form a refractory embedded induction coil. A flowable refractory mold is positioned within the wound induction coil to provide a cast flowable refractory volume between the outer wall of the flowable refractory mold and the inner wall of the refractory embedded induction coil. At least one electrically conductive mesh is fitted around the outer wall of the flowable refractory mold. A cast flowable refractory is poured into the flowable refractory volume to embed the at least one electrically conductive mesh in the cast flowable refractory to form an embedded mesh castable refractory. The flowable refractory mold is removed, and a replaceable lining mold is positioned within the volume of the embedded mesh flowable refractory to establish a replaceable lining wall volume between the outer wall of the replaceable lining mold and the inner wall of the embedded mesh castable refractory, and a replaceable lining bottom volume above the foundation. A replaceable lining refractory is fed into the replaceable lining wall volume and the replaceable lining bottom volume, and the replaceable lining mold is removed.

In another aspect, the invention is an electric induction heating or melting furnace with a lining wear detection system that can detect furnace lining wear when the furnace is properly operated and maintained.

These and other aspects of the invention are set forth in the specification and the appended claims.

BRIEF DESCRIPTION OF THE DRAWINGS

The figures, in conjunction with the specification and claims, illustrate one or more non-limiting modes of practicing the invention. The invention is not limited to the illustrated layout and content of the drawings.

FIG. 3(*b*) illustrates in top plan view the electrically conductive mesh shown in FIG. 3(*a*) in the shape as installed around the circumference of the electric induction furnace shown in FIG. 2.

FIG. 6(*g*) illustrates fabrication of another example of an electric induction furnace with a lining wear detection system of the present invention where standoffs are used to offset a mesh from the inner wall perimeter of cast flowable refractory

DETAILED DESCRIPTION OF THE INVENTION

Figure 1:
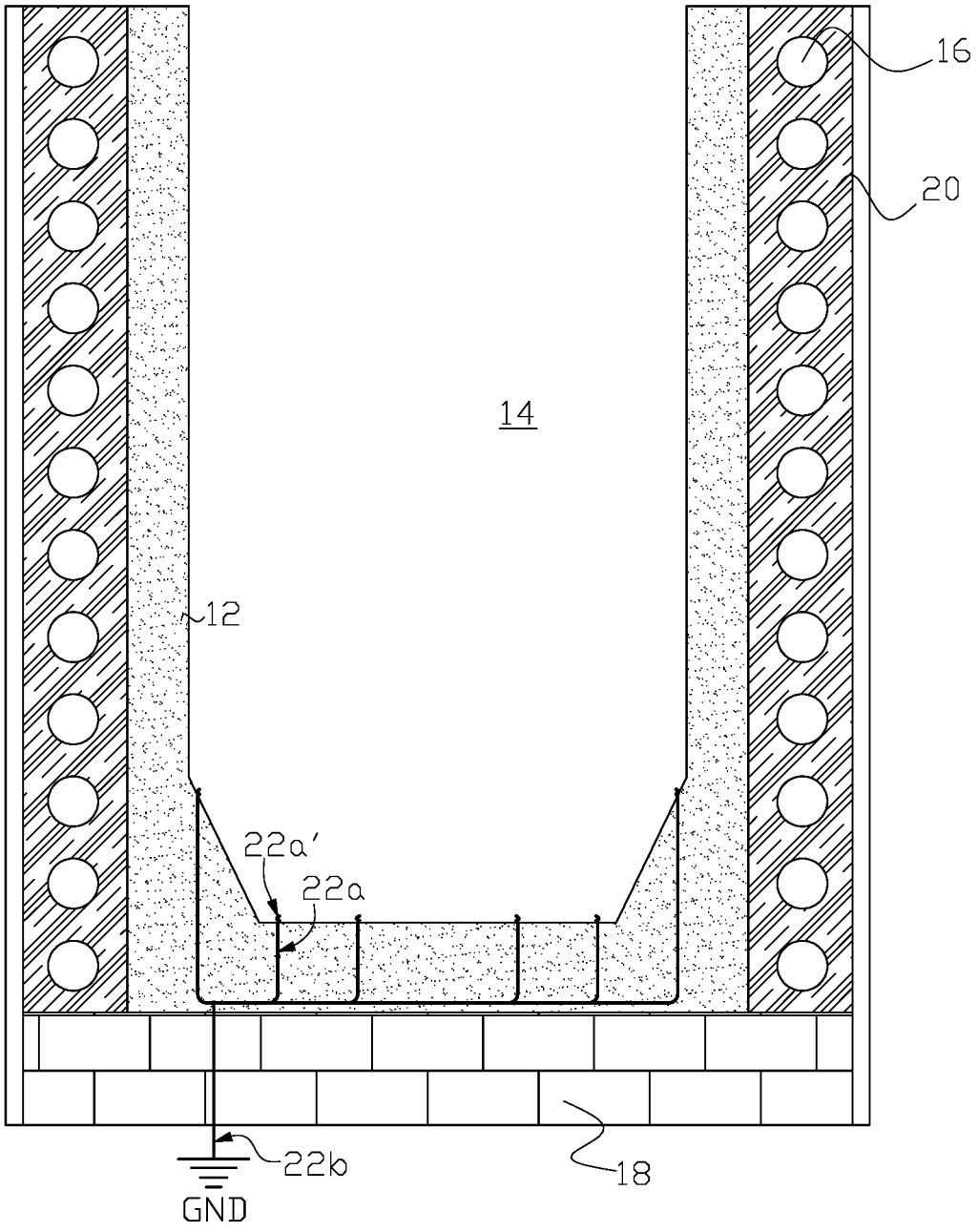
FIG. 1 PRIOR ART
FIG. 1 is a simplified cross sectional diagram of one example of an electric induction furnace.
Figure 2:
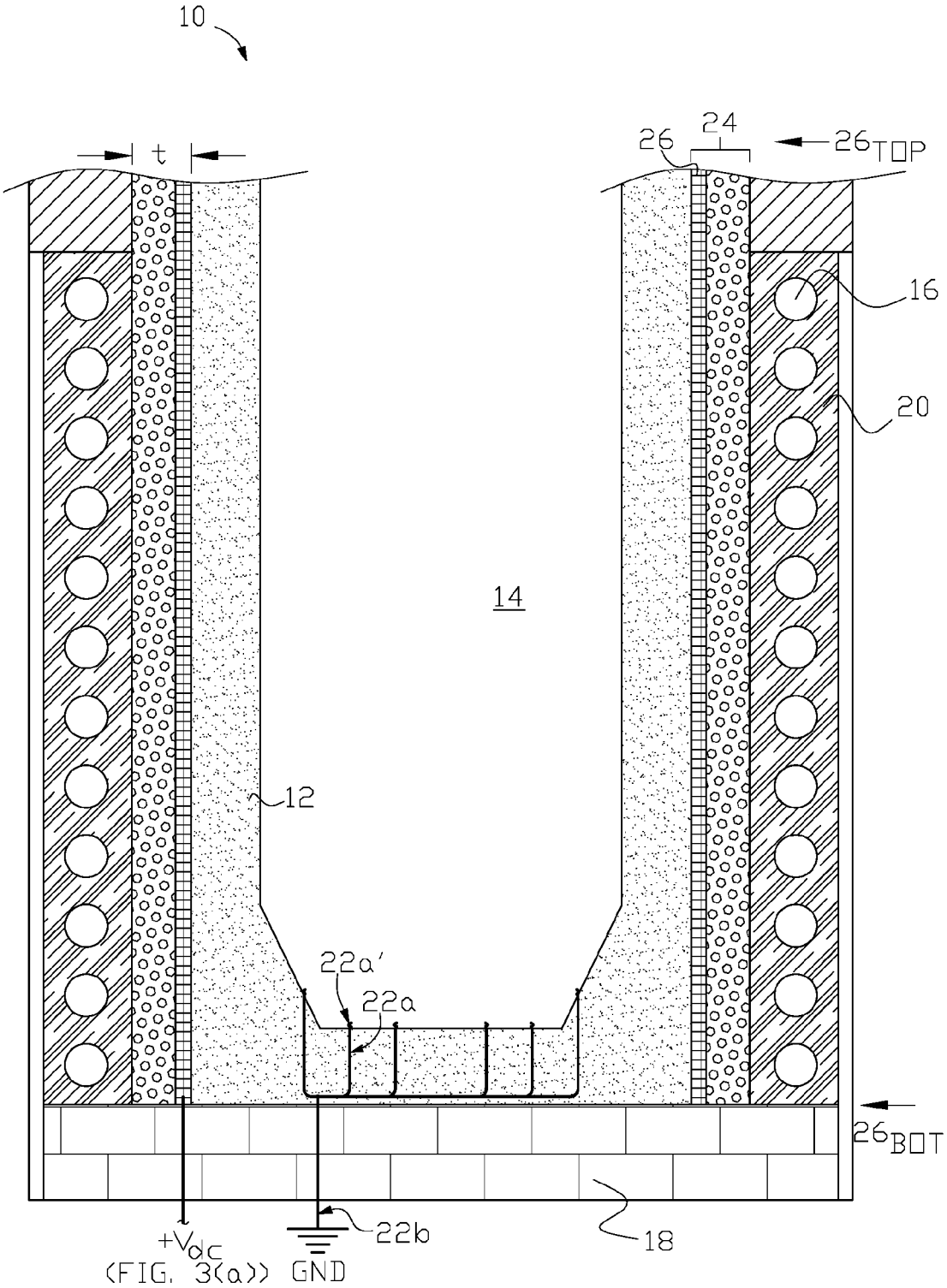
FIG. 2 is a cross sectional diagram of one example of an electric induction furnace with a lining wear detection system of the present invention.
Figure 3A:
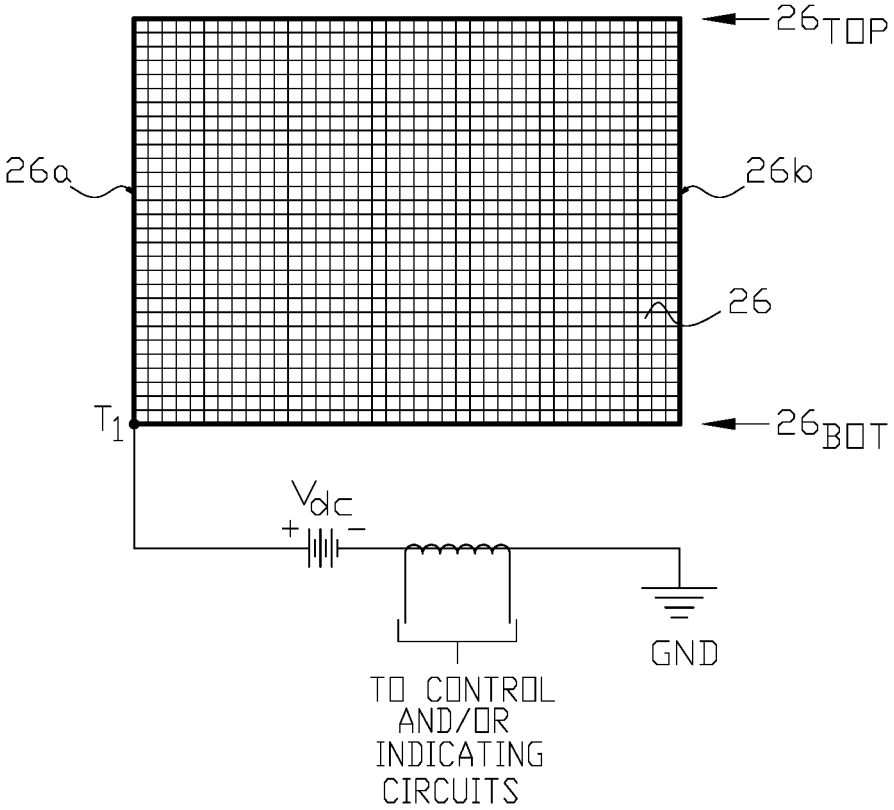
FIG. 3(*a*) illustrates in flat planar view one example of an electrically conductive mesh, a lining wear detection circuit, and a control and/or indicating (detector) circuit used in the electric induction furnace shown in FIG. 2
Figure 3B:
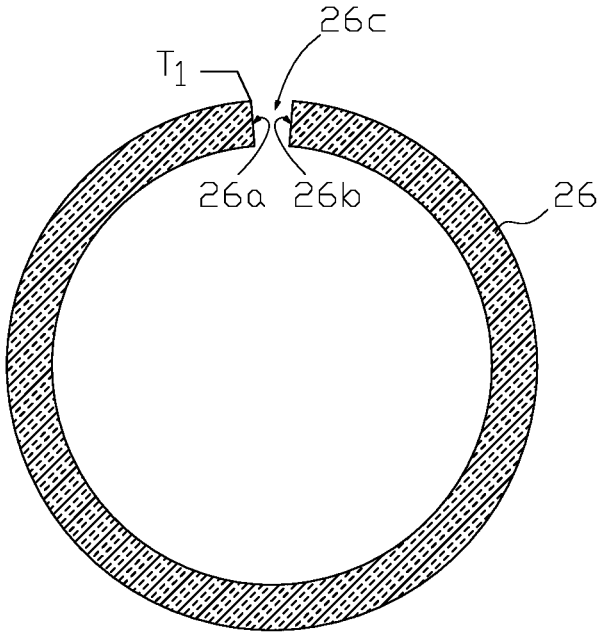

There is shown in FIG. 2 one example of an electric induction furnace 10 with a lining wear detection system of the present invention. A cast flowable refractory 24 is disposed between coil 16 and replaceable furnace lining 12. In this example of the invention, electrically conductive mesh 26, (for example, a stainless steel mesh) is embedded within the inner boundary of castable refractory 24 that is adjacent to the outer boundary of lining 12. One non-limiting example of a suitable mesh is formed from type 304 stainless steel welded wire cloth with mesh size 4×4; wire diameter between 0.028-0.032-inch; and opening width of 0.222-0.218-inch. As shown in FIGS. 3(*a*) and 3(*b*), for this example of the invention, mesh 26 forms a discontinuous cylindrical mesh boundary between castable refractory 24 and lining 12 from the top ($\mathbf{26}_{TOP}$) to the bottom ($\mathbf{26}_{BOT}$) of the outer boundary of the lining wall. One vertical side 26*a* of mesh 26 is suitably connected to a positive electric potential that can be established by a suitable voltage source, such as direct current (DC) voltage source $V_{dc}$ that has its other terminal connected to furnace electrical ground (GND). A lining wear detection circuit is formed between the positive electric potential connected to the electrically conductive mesh and the negative electric potential connected to the furnace electrical ground. Vertical discontinuity 26*c* (along the height of the lining in this example) in mesh 26 is sized to prevent short circuiting between opposing vertical sides 26*a* and 26*b* of mesh 26. Alternatively the mesh may be fabricated in a manner so that the mesh is electrically isolated from itself; for example, a layer of electrical insulation can be provided between two overlapping ends (sides 26*a* and 26*b* in this example) of the mesh. As shown in FIG. 3(*a*) the voltage source circuit can be connected to control and/or indicating circuits via suitable circuit elements such as a current transformer. The control and/or indicating circuits are referred to collectively as a detector. As lining 12 is gradually consumed during the service life of the furnace, DC leakage current will rise, which can be sensed in the control/indicating circuits. For a particular furnace design, a leakage current rise level set point can be established for indication of lining replacement when the furnace is properly operated and maintained.

Figure 4:
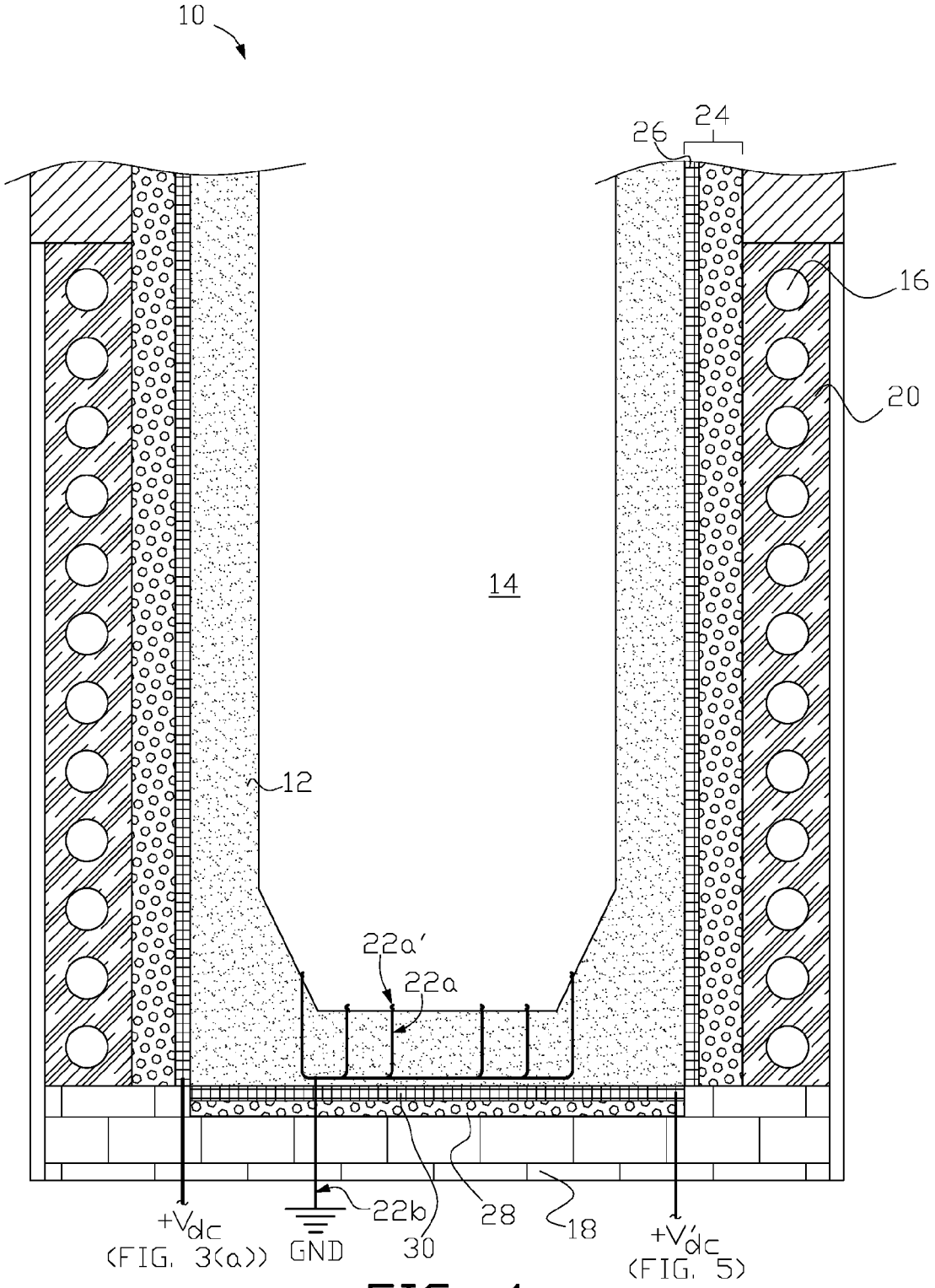
FIG. 4 is a cross sectional diagram of another example of an electric induction furnace with a lining wear detection system of the present invention that includes a bottom electrically conductive mesh.
Figure 5:
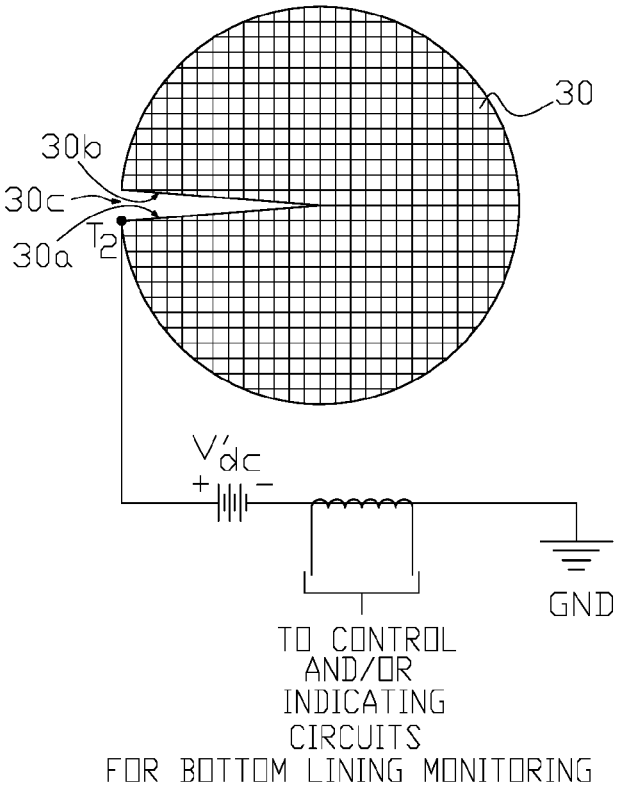
FIG. 5 illustrates in top plan view a bottom electrically conductive mesh, bottom lining wear detection circuit, and control and/or indicating (detector) circuit used for bottom lining wear detection in one example of the present invention.

In some examples of the invention, a bottom lining wear detection system may be provided as shown, for example in FIG. 4, in addition to the wall lining wear detection system shown in FIG. 2. In FIG. 4 electrically conductive bottom mesh 30 is disposed within cast flowable refractory 28 with bottom mesh 30 adjacent to the lower boundary of lining 12 at the bottom of the furnace. As shown in FIG. 5 in this example of the invention, bottom mesh 30 forms a discontinuous circular mesh boundary between bottom cast flowable refractory 28 and the bottom of lining 12. One discontinuous radial side 30*a* of bottom mesh 30 is suitably connected to a positive electric potential established by a suitable voltage source $V'_{dc}$ that has its other terminal connected to furnace electrical ground (GND). A bottom lining wear detection circuit is formed between the positive electric potential connected to the electrically conductive bottom mesh and the negative electric potential connected to the furnace electrical ground. Radial discontinuity 30*c* in mesh 30 is sized to prevent short circuiting between opposing radial sides 30*a* and 30*b* of mesh 30. Alternatively the mesh may be fabricated in a manner so that the mesh is electrically isolated from itself; for example, a layer of electrical insulation can be provided between two overlapping ends (radial sides 30*a* and 30*b* in this example) of the mesh. As shown in FIG. 5, the bottom lining wear detection circuit can be connected to a bottom lining wear control and/or indicating circuits, which are collectively referred to as a detector. As the bottom of lining 12 is gradually consumed during the service life of the furnace, DC leakage current will rise, which can be sensed in the bottom lining wear control and/or indicating circuits. For a particular furnace design, a leakage current rise level set point can be established for indication of lining replacement, based on bottom lining wear, when the furnace is properly operated and maintained.

The particular arrangements of the discontinuous side wall and bottom meshes shown in the figures are one example of discontinuous mesh arrangements of the present invention. The purpose for the discontinuity is to prevent eddy current heating of the mesh from inductive coupling with the magnetic flux generated when alternating current is flowing through induction coil 16 when the coil is connected to a suitable alternating current power source during operation of the furnace. Therefore other arrangements of side wall and bottom meshes are within the scope of the invention as long as the mesh arrangement prevents such inductive heating of the mesh. Similarly arrangement of the electrical connection(s) of the mesh to the lining wear detection circuit, and the control and/or indicating circuits can vary depending upon a particular furnace design.

Figure 8:
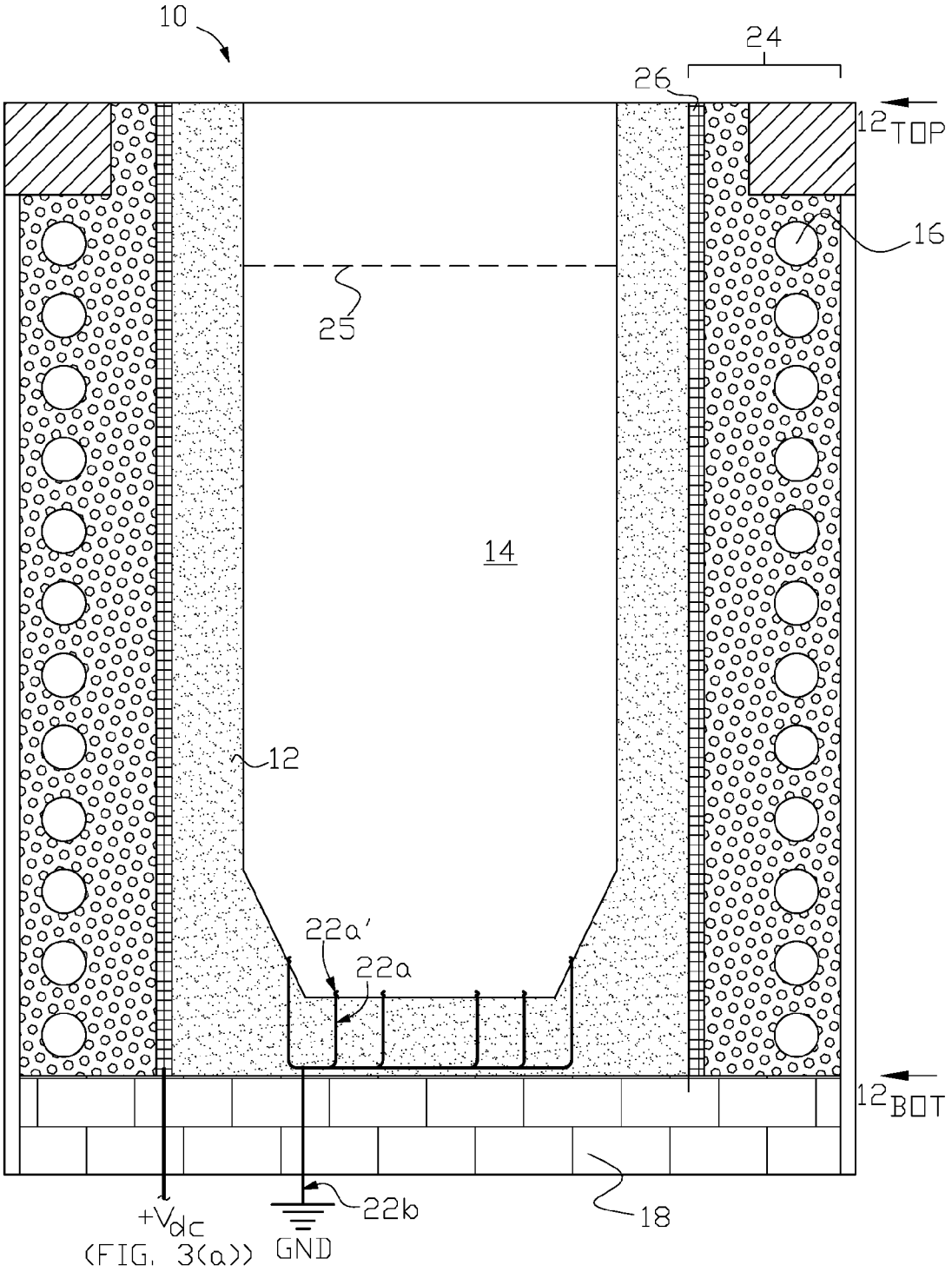
FIG. 8 is a cross sectional diagram of another example of an electric induction furnace with a lining wear detection system of the present invention.
Figure 9C:
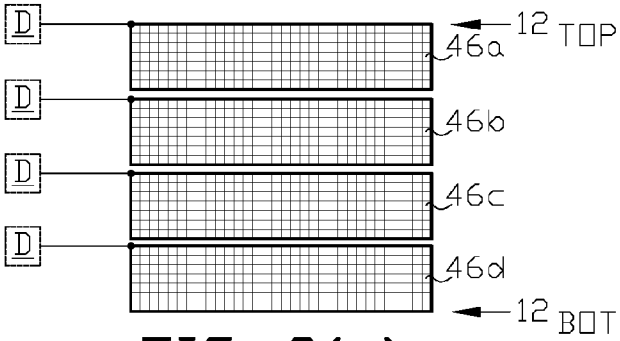
FIG. 9(*a*) through FIG. 9(*d*) illustrate alternative arrangements of electrically conductive mesh, lining wear detection circuits and detectors used in the electric induction furnace with a lining wear detection system of the present invention.
Figure 9D:
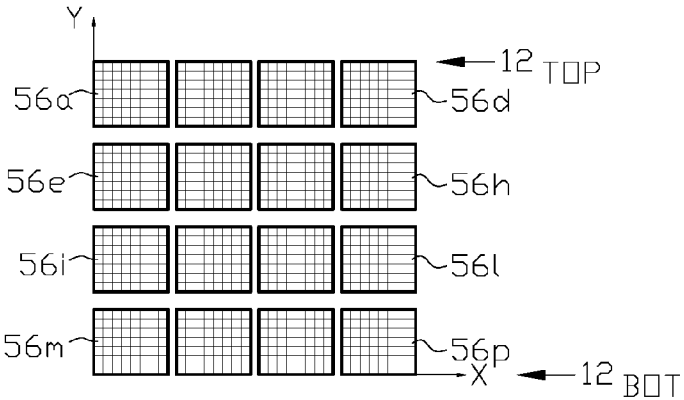
Figure 9A:
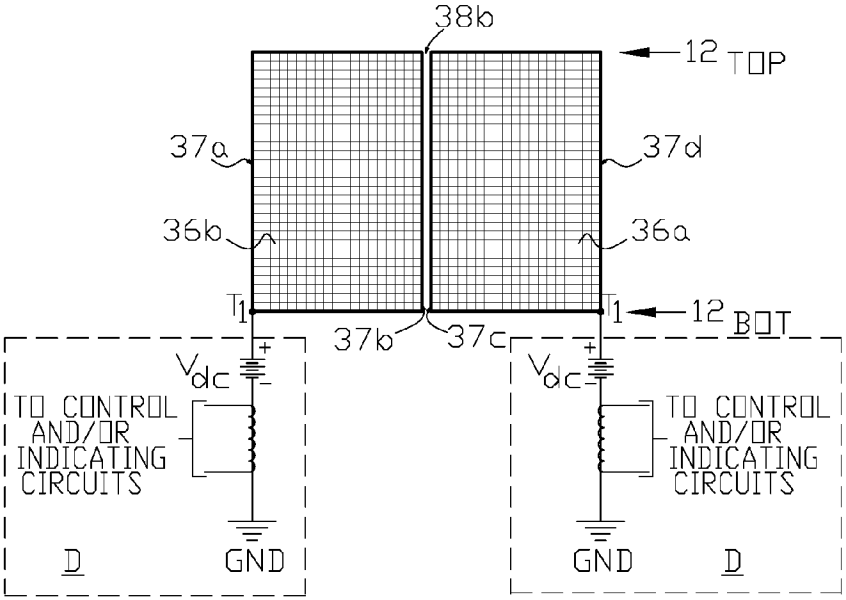
Figure 9B:
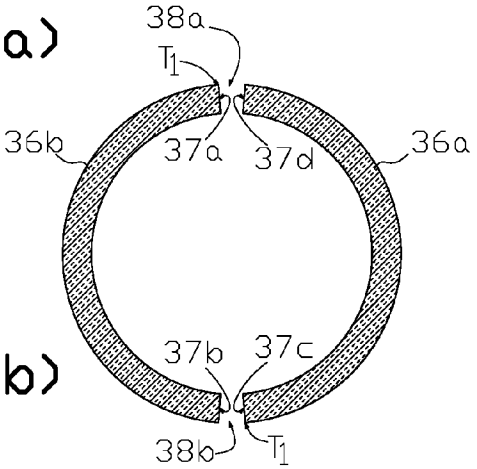

In some examples of the invention refractory embedded wall mesh 26 may extend for the entire vertical height of lining 12, that is, from the bottom ($\mathbf{12}_{BOT}$) of the furnace lining to the very top ($\mathbf{12}_{TOP}$) of the furnace lining that is above the nominal design melt line 25 for a particular furnace as shown, for example, in FIG. 8.

In other applications, wall mesh 26 may be provided in one or more selected discrete regions along the vertical height of lining 12. For example in FIG. 9(*a*) and FIG. 9(*b*) wall mesh comprises two vertical electrically conductive meshes 36*a* and 36*b* that are electrically isolated from each other and connected to separate lining wear detection circuits so that lining wear can be diagnosed as being on either one half side of the furnace lining. In this example there are two electrical discontinuities 38*a* (formed between vertical sides 37*a* and 37*d*) and 38*b* (formed between vertical sides 37*b* and 37*c*) along the vertical height of the two meshes 36*a* and 36*b*. Further any multiple of separate, vertically oriented and electrically isolated wall mesh regions may be provided along the vertical height of lining 12 with each separate wall mesh region being connected to a separate lining wear detection circuit so that lining wear could be localized to one of the wall mesh regions. Alternatively as shown in FIG. 9(*c*) the multiple electrically conductive meshes 46*a* through 46*d* can be horizontally oriented with each electrically isolated mesh connected to a separate lining wear detection circuit and control and/or indicating circuits (D) so that lining wear can be localized to one of the isolated mesh regions. Most generally as shown in FIG. 9(*d*) the multiple electrically conductive meshes 56*a* through 56*p* can be arrayed around the height of the replaceable lining wall with each electrically conductive mesh connected to a separate lining wear detection circuit, and control and/or indicating circuits (not shown in the figure) so that lining wear can be localized to one of the isolated mesh regions that can be defined by a two-dimensional X-Y coordinate system around the circumference of the replaceable lining wall with the X coordinate defining a position around the circumference of the lining and the Y coordinate defining a position along the height of the lining.

In similar fashion bottom mesh 30 may cover less than the entire bottom of replaceable lining 12 in some examples of the invention, or comprise a number of electrically isolated bottom meshes with each of the electrically isolated bottom meshes connected to a separate lining wear detection circuit so that lining wear could be localized to one of the bottom mesh regions.

Alternatively to a separate detector (control and/or indicating circuits) used with each lining wear detection circuit in the above examples, a single detector can be switchably connected to the lining wear detection circuits associated with two or more of the electrically isolated meshes in all examples of the invention.

While the figures illustrate separate wall and bottom lining wear detection systems, in some examples of the invention, a combined wall and bottom lining wear detection system may be provided either by (1) providing a continuous side and bottom mesh embedded in an integrally cast flowable refractory with a single lining wear detection circuit and detector or (2) providing separate side and bottom meshes embedded in a cast flowable refractory with a common lining wear detection circuit and detector.

FIG. 6(*a*) through FIG. 6(*f*) illustrate one example of fabrication of an electric induction furnace with a lining wear detection system of the present invention. Induction coil 16 can be fabricated (typically wound) and positioned over suitable foundation 18. As shown in FIG. 6(*a*) trowelable refractory (grout) material 20 can be installed around the coil as in the prior art. One suitable proprietary trowelable refractory material 20 is INDUCTOCOAT™ 35AF (available from Inductotherm Corp., Rancocas, N.J.). If a bottom lining wear detection system is used, bottom mesh 30 can be fitted at the top of foundation 18 and embedded in cast flowable refractory 28 by pouring the cast flowable refractory around bottom mesh 30 so that the mesh is embedded within the refractory after it sets as shown in FIG. 6(*b*). Alternatively the bottom mesh can be cast in a cast flowable refractory in a separate mold and then the cast refractory embedded bottom mesh can be installed in the bottom of the furnace after the cast flowable refractory sets.

Figure 7:
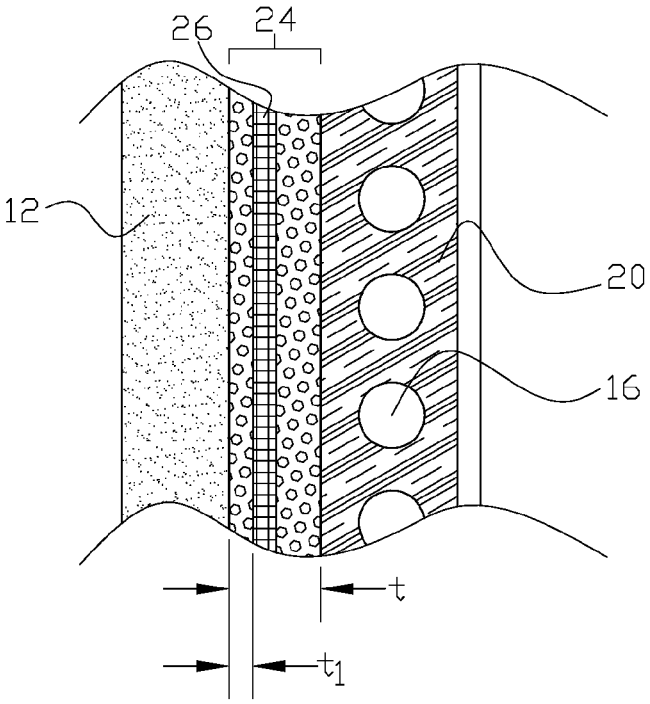
FIG. 7 is a detail of one example of the electrically conductive mesh embedded in a cast flowable refractory used in an electric induction furnace with a lining wear detection system of the present invention.
Figure 6A:
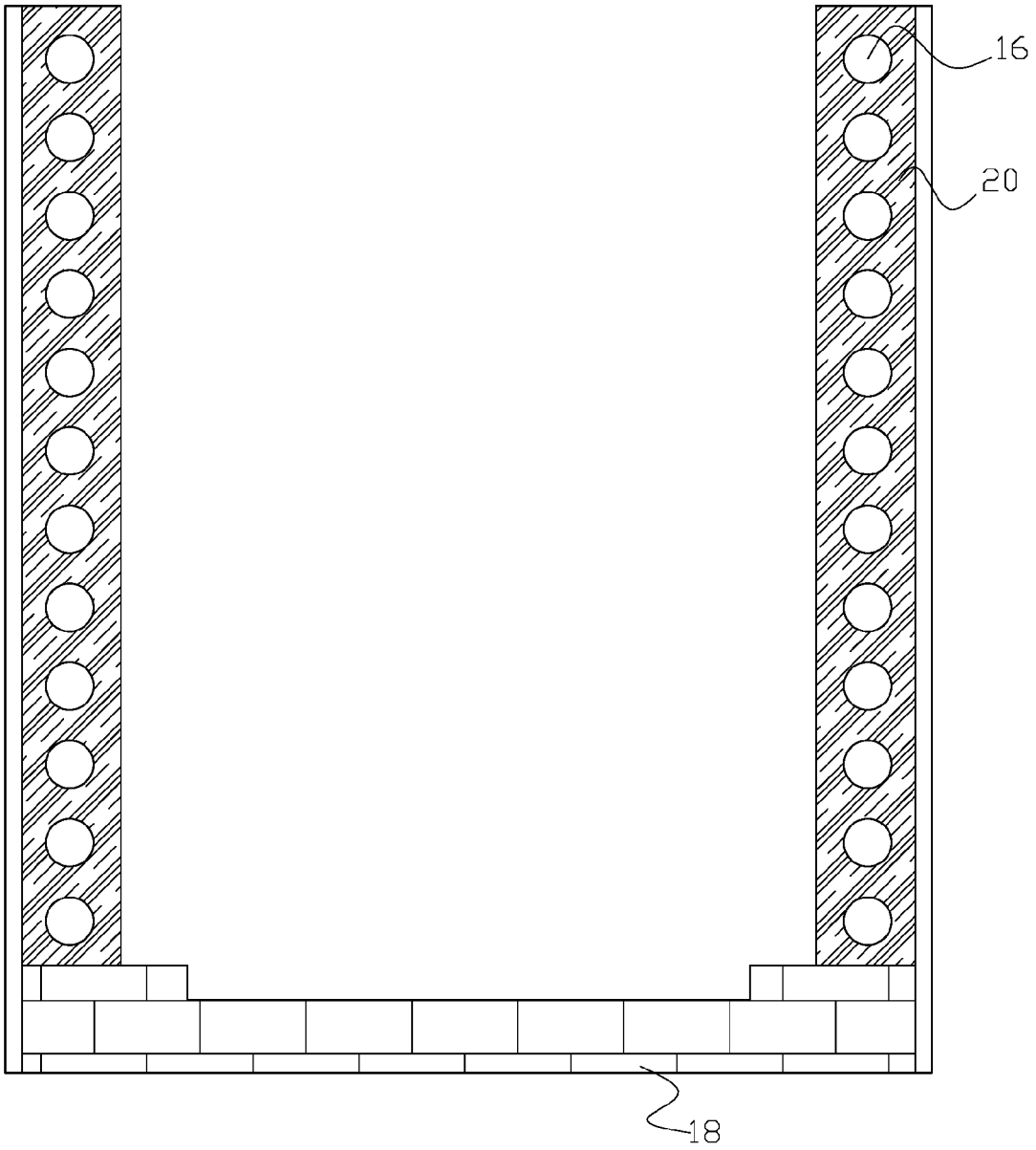
FIG. 6(*a*) through FIG. 6(*f*) illustrate fabrication of one example of an electric induction furnace with a lining wear detection system of the present invention.
Figure 6B:
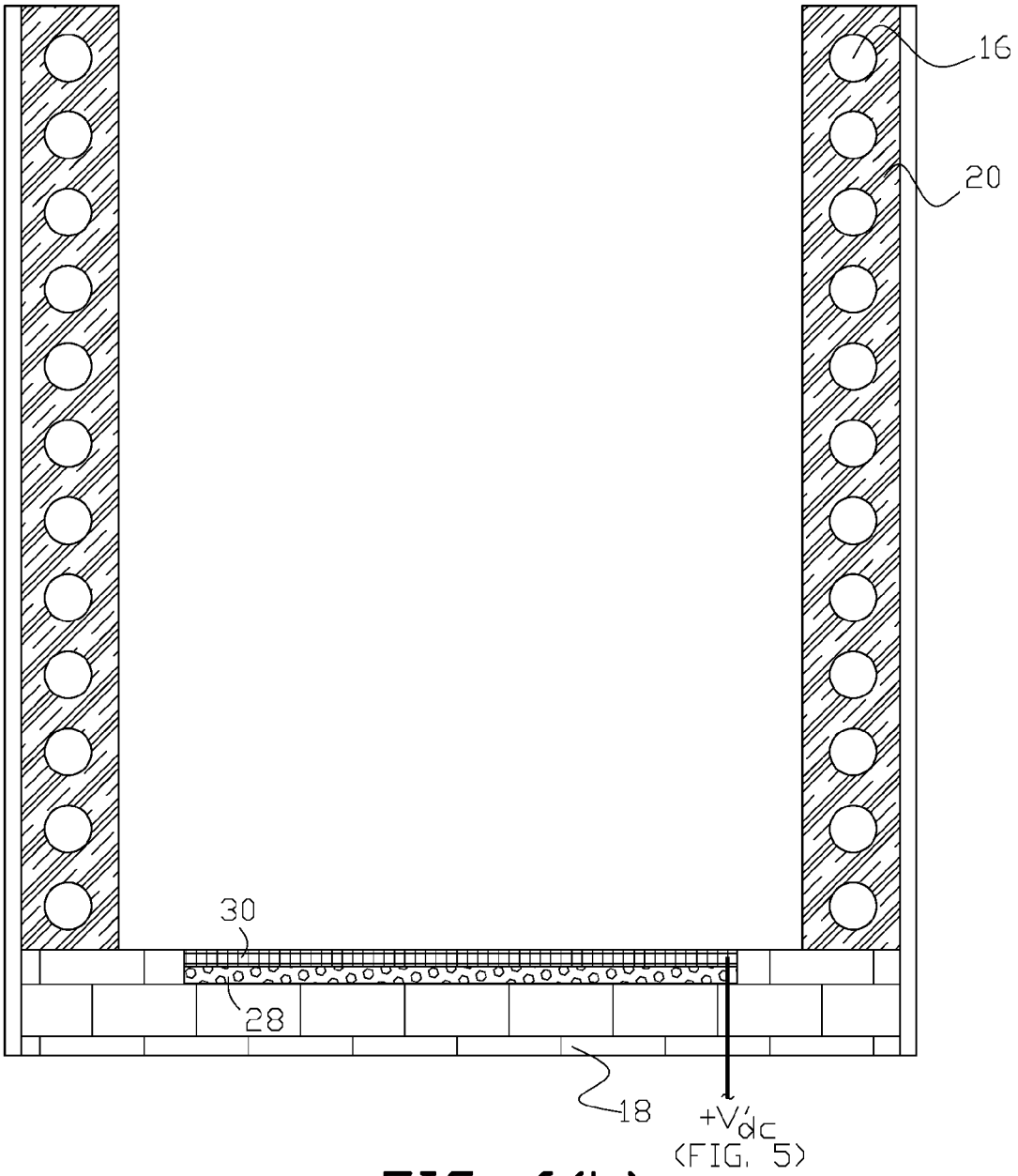
Figure 6C:
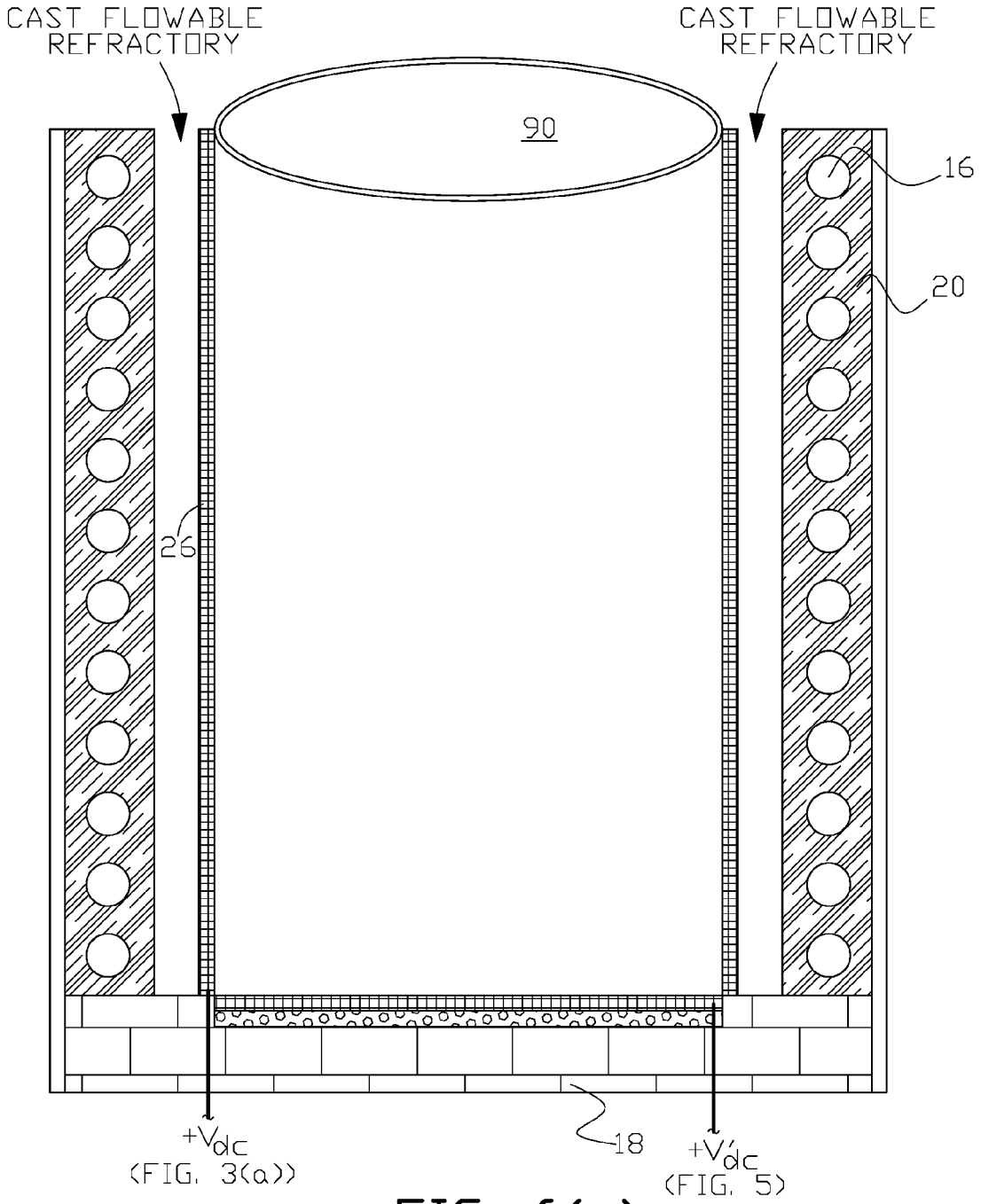
Figure 6D:
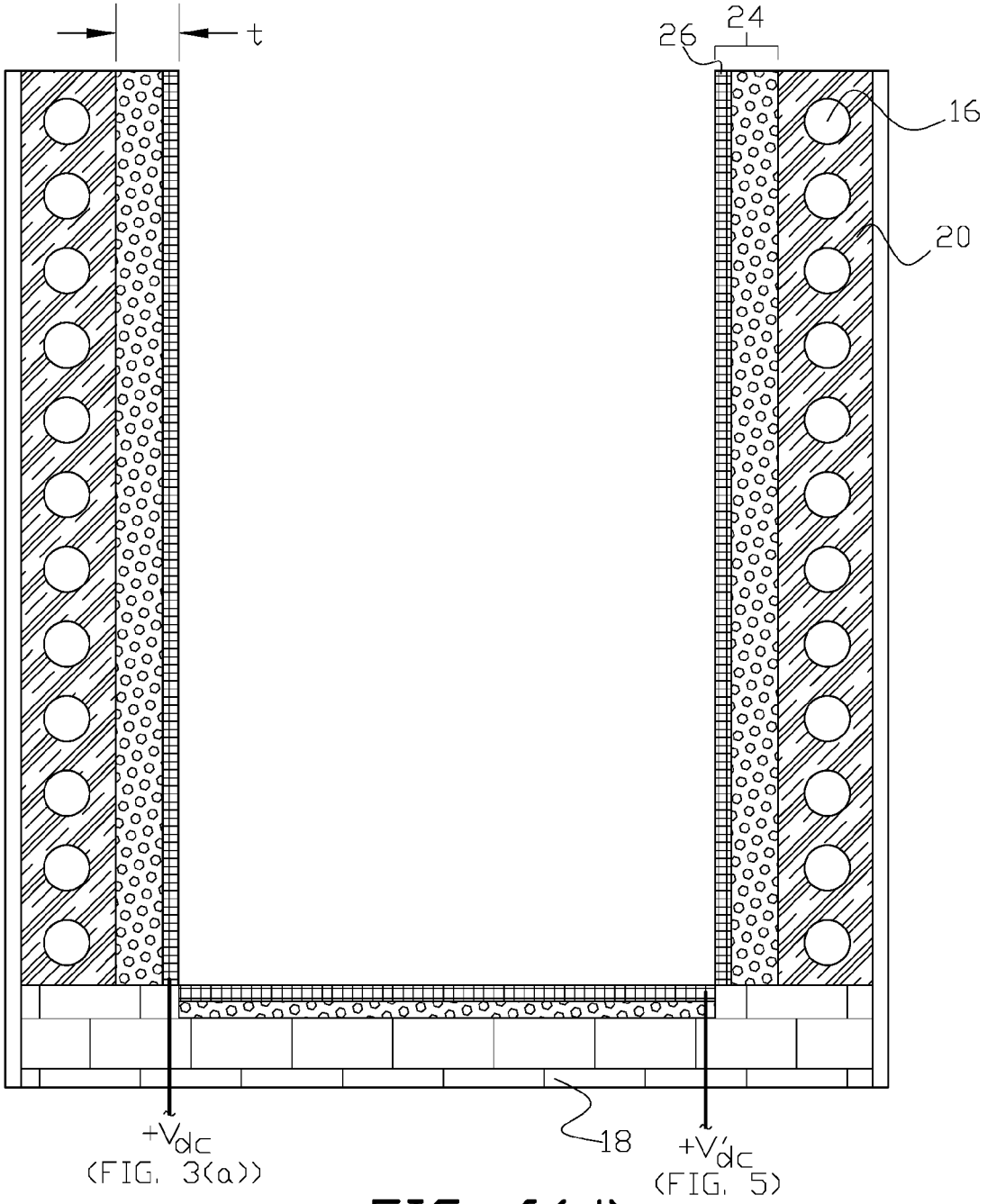
Figure 6E:
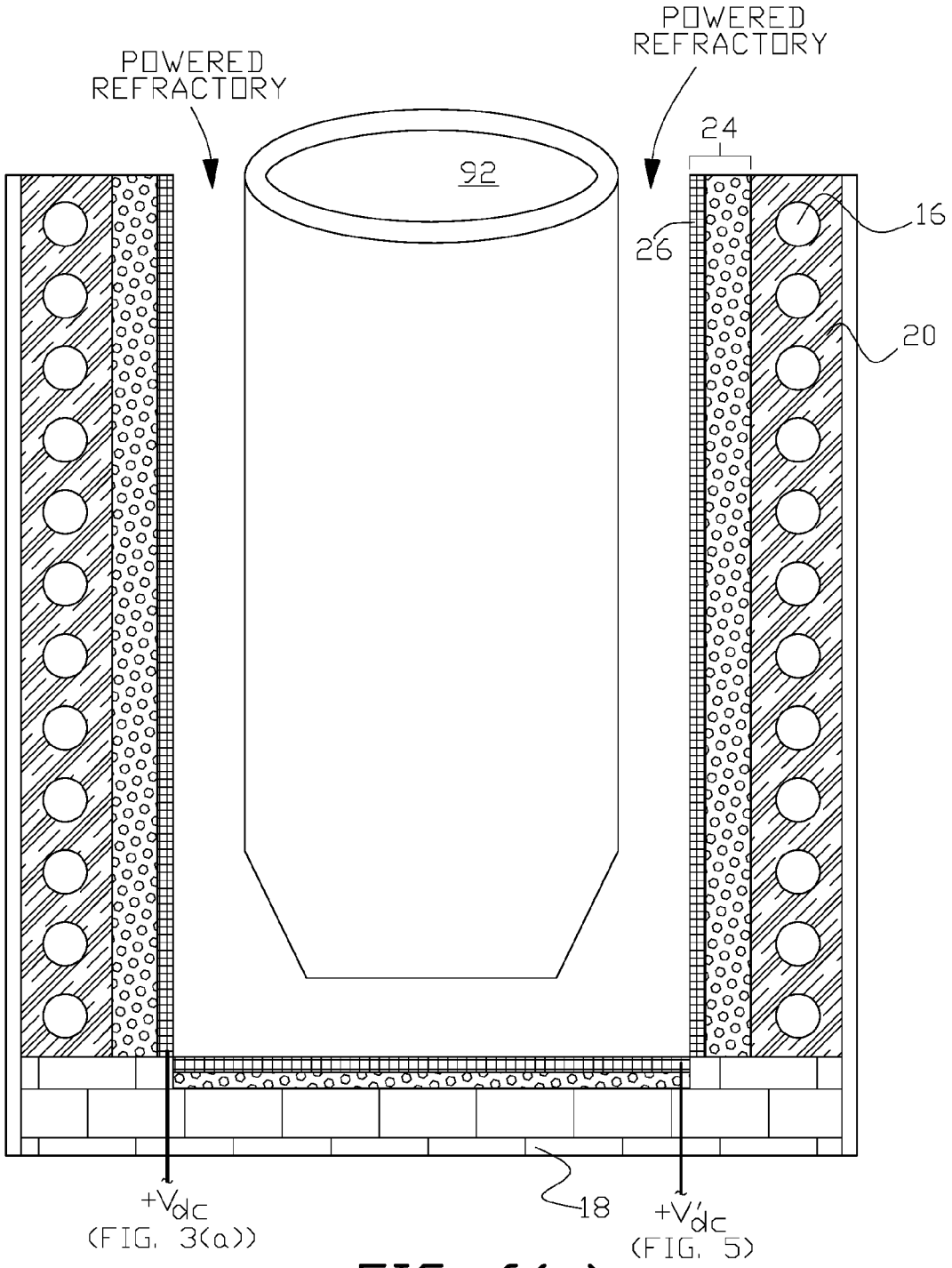
Figure 6F:
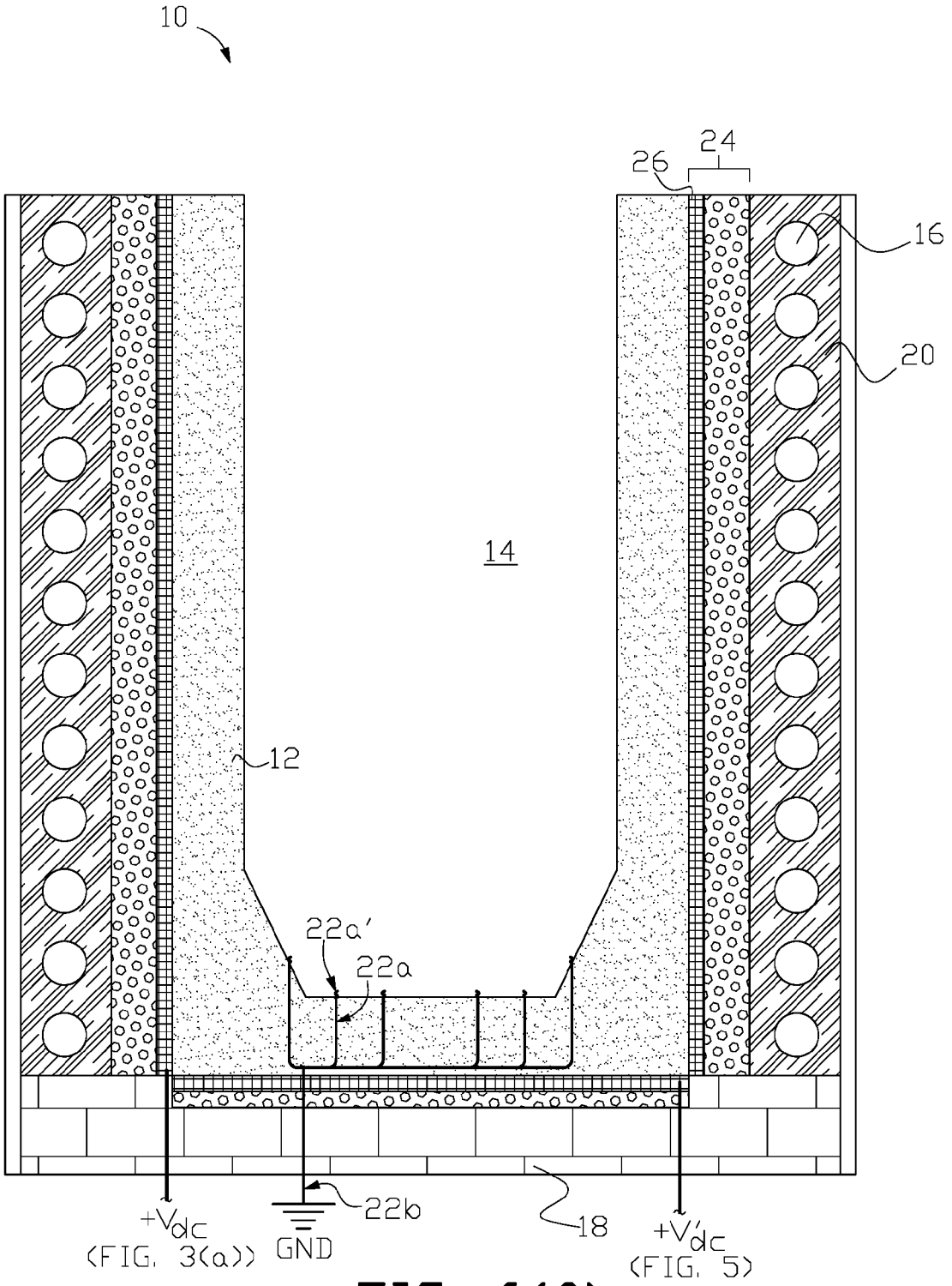
Figure 6G:
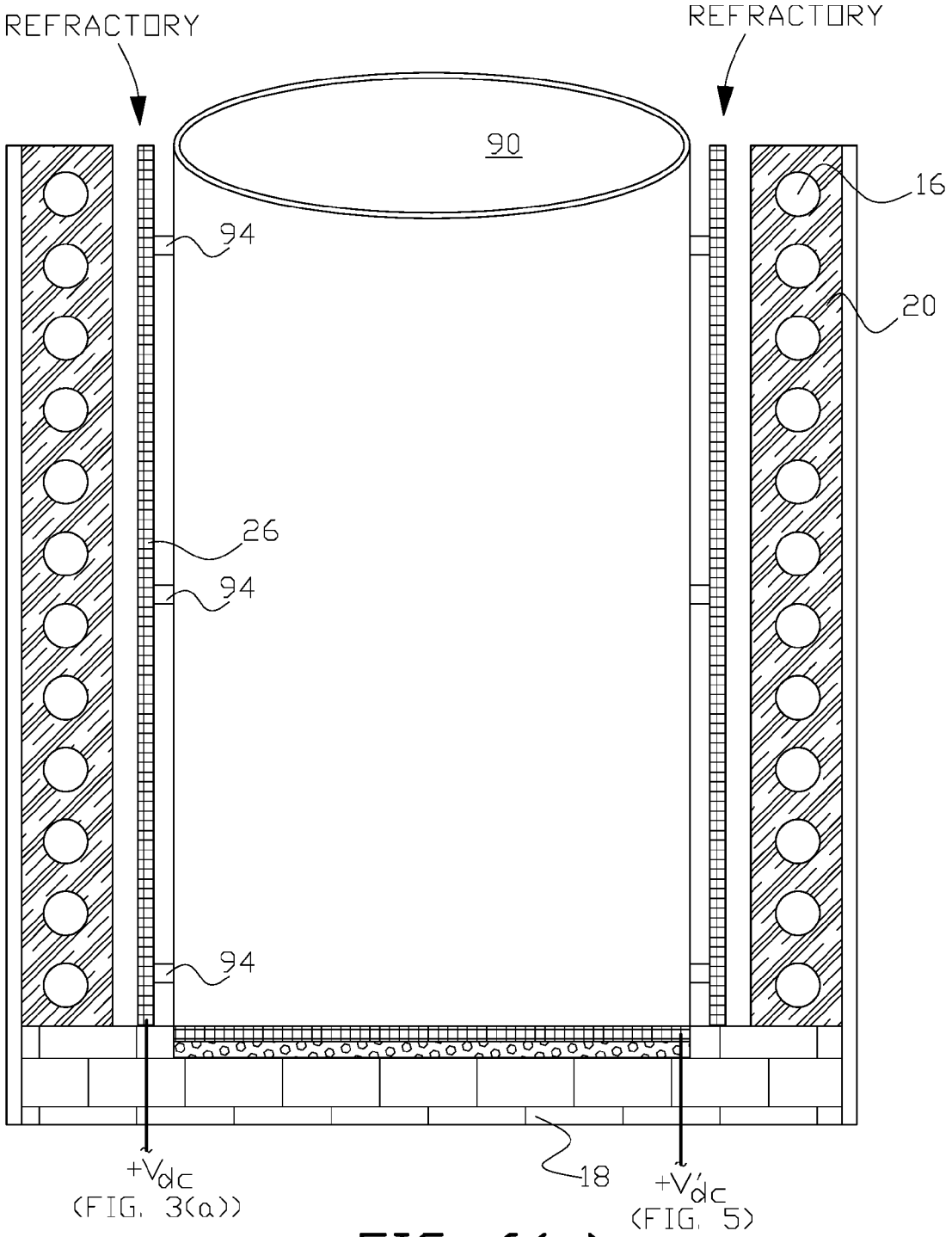

A suitable temporary cast flowable refractory mold 90 (or molds forming a formwork) for example, in the shape of an open right cylinder, is positioned within the volume formed by coil 16 and refractory material 20 to form a cast flowable refractory annular volume between refractory material 20 and the outer wall perimeter of the mold as shown in FIG. 6(*c*). Mesh 26 is fitted around the outer perimeter of temporary mold 90 and the cast flowable refractory 24, such as INDUCTOCOAT™ 35AF-FLOW (available from Inductotherm Corp., Rancocas, N.J.), can be poured into the cast flowable refractory annular volume to set and form hardened castable refractory 24 as shown in FIG. 6(*d*). Vibrating compactors can be used to release trapped air and excess water from the cast flowable refractory so that the refractory settles firmly in place in the formwork before setting. Mesh 26 will be at least partially embedded in cast flowable refractory 24 when it sets inside of the cast flowable refractory annular volume. In other examples of the invention mesh 26 can be embedded anywhere within the thickness, t, of cast flowable refractory 24. For example as shown in FIG. 7, mesh 26 is offset by distance, $t_1$, from the inner wall perimeter of cast flowable refractory 24. Offset embedment can be achieved by installing suitable standoffs 94 around the outer perimeter of mold 90 as illustrated in FIG. 6 (*g*)and then fitting mesh 26 around the standoffs before pouring the cast flowable refractory. In the broadest sense as used herein, the terminology mesh "embedded" in a cast flowable refractory means the mesh is either fixed within the refractory; at a surface boundary of the refractory, or sufficiently, but not completely, embedded at a surface boundary of the refractory so that the mesh is retained in place in the refractory after the refractory sets.

After cast flowable refractory 24 sets, temporary mold 90 is removed, and a replaceable lining mold 92 that is shaped to conform to the boundary wall and bottom of interior furnace volume 14 can be positioned within the volume formed by set cast flowable refractory 24 (with embedded mesh 26) to form a replaceable lining annular volume between set cast flowable refractory 24 and the outer wall perimeter of the lining mold 92 as shown in FIG. 6(*e*). A conventional powder refractory can then be fed into the lining volume according to conventional procedures. If lining mold 92 is formed from an electrically conductive mold material, lining mold 92 can be heated and melted in place according to conventional procedures to sinter the lining refractory layer that forms the boundary of furnace volume 14. Alternatively the lining mold may be removed and sintering of the lining refractory layer may be accomplished by direct heat application.

Distinction is made between the replaceable lining refractory, which is typically a powder refractory and the cast flowable refractory in which the electrically conductive mesh is embedded. The cast flowable refractory is used so that the electrically conductive mesh can be embedded in the refractory. The cast flowable refractory is also referred to herein as castable refractory and flowable refractory.

FIG. 6(*f*) illustrates an electric induction furnace with one example of a lining wear detection system of the present invention with addition of typical furnace ground leak detector system probe wires 22*a* and electrical ground lead 22*b* that is connected to a furnace electrical ground (GND)

The fabrication process described above and as shown in FIG. 6(*a*) through FIG. 6(*f*) illustrates one example of fabrication steps exemplary to the present invention. Additional conventional fabrication steps may be required to complete furnace construction.

In alternative examples of the invention rather than using a separate trowelable refractory (grout) around coil 16, cast flowable refractory 24 can be extended to, and around coil 16.

The induction furnace of the present invention may be of any type, for example, a bottom pour, top tilt pour, pressure pour, or push-out electric induction furnace, operating at atmosphere or in a controlled environment such as an inert gas or vacuum. While the induction furnace shown in the figures has a circular interior cross section, furnaces with other cross sectional shapes, such as square, may also utilize the present invention. While a single induction coil is shown in the drawing for the electric induction furnace of the present invention, the term "induction coil" as used herein also includes a plurality of induction coils either with individual electrical connections and/or electrically interconnected induction coils.

Further the lining wear detection system of the present invention may also be utilized in portable refractory lined ladles used to transfer molten metals between locations and stationary refractory lined launders.

The examples of the invention include reference to specific electrical components. One skilled in the art may practice the invention by substituting components that are not necessarily of the same type but will create the desired conditions or accomplish the desired results of the invention. For example, single components may be substituted for multiple components or vice versa.

The invention claimed is:

1. A method of fabricating an electric induction furnace with a lining wear detection system, the method comprising the steps of:

locating a wound induction coil above a foundation;

installing a refractory around the wound induction coil to form a refractory embedded induction coil;

positioning a flowable refractory mold within the refractory embedded induction coil to provide a cast flowable refractory volume between an outer flowable refractory mold wall of the flowable refractory mold and an inner refractory embedded induction coil wall of the refractory embedded induction coil;

fitting at least one electrically conductive mesh around the outer flowable refractory mold wall of the flowable refractory mold;

pouring a cast flowable refractory into the cast flowable refractory volume to embed the at least one electrically conductive mesh in the cast flowable refractory to form an embedded mesh castable refractory in the cast flowable refractory volume;

removing the flowable refractory mold to form an interior cast flowable refractory furnace volume;

positioning a replaceable lining mold within the interior cast flowable refractory furnace volume to form a replaceable lining wall volume between an outer replaceable lining mold wall of the replaceable lining mold and an inner embedded mesh castable refractory wall of the embedded mesh castable refractory, and a replaceable lining bottom volume above the foundation;

feeding a replaceable lining refractory into the replaceable lining wall volume and the replaceable lining bottom volume; and removing the replaceable lining mold to form an interior volume of the electric induction furnace.

2. The method of claim 1 further comprising the step of fitting at least one bottom electrically conductive mesh embedded in the cast flowable refractory above the foundation and below the replaceable lining bottom volume.

3. The method of claim 1 further comprising the step of installing a lining wear detection circuit from each of the at least one electrically conductive mesh to a furnace electrical ground connection.

4. The method of claim 3 further comprising the step of installing at least one detector for the lining wear detection circuit.

5. The method of claim 2 further comprising the step of installing a bottom lining wear detection circuit from each of the at least one bottom electrically conductive mesh to a furnace electrical ground connection.

6. The method of claim 5 further comprising the step of installing at least one detector for the bottom lining wear detection circuit.

7. The method of claim 1 further comprising the step of inserting one or more standoffs around the outer flowable refractory mold wall and fitting the at least one electrically conductive mesh around the one or more standoffs.

8. A method of fabricating an electric induction furnace with a lining wear detection system, the method comprising:

forming a replaceable lining having a replaceable lining inner boundary surface and a replaceable lining outer boundary surface, the replaceable lining inner boundary surface of the replaceable lining forming an interior volume of the electric induction furnace;

at least partially surrounding an exterior height of the replaceable lining with at least one induction coil having an inner induction coil wall;

forming a furnace ground circuit with a first furnace ground circuit end located at an at least one ground probe protruding into the interior volume of the electric induction furnace and a second furnace ground circuit end terminating at an electrical ground connection external to the electric induction furnace;

forming at least one electrically conductive mesh embedded in a castable refractory between the replaceable lining outer boundary surface of the replaceable lining and the inner induction coil wall to establish an electrically discontinuous mesh boundary between the castable refractory and the replaceable lining outer boundary surface; and connecting a positive electric potential of a direct current voltage source to the at least one electrically conductive mesh and connecting a negative electric potential of the direct current voltage source to the electrical ground connection to establish a lining wear detection circuit between the positive electric potential connected to the at least one electrically conductive mesh and the negative electric potential connected to the electrical ground connection to detect a level of a DC leakage current in the lining wear detection circuit as the replaceable lining is consumed from repeated melts in the interior volume of the electric induction furnace;

forming an at least one electrically conductive bottom mesh embedded in a bottom castable refractory disposed below the outer boundary surface of the bottom of the replaceable lining to establish an electrically discontinuous mesh boundary below the bottom castable refractory in which the at least one electrically conductive bottom mesh is embedded; and connecting a bottom lining wear positive electric potential of a bottom lining wear direct current voltage source to the at least one electrically conductive bottom mesh and connecting a bottom lining wear negative electric potential to the electrical ground connection whereby a bottom lining wear detection circuit is established between the bottom lining wear positive electric potential connected to the at least one electrically conductive mesh and the bottom lining wear negative electric potential connected to the electrical ground connection to detect a bottom lining level of a bottom lining DC leakage current in the bottom lining wear detection circuit as the replaceable lining is consumed.

9. The method of claim 8 further comprising embedding the at least one electrically conductive mesh within a thickness of the castable refractory.

10. The method of claim 8 further comprising installing a single lining wear detector in the lining wear detection circuit to detect the level of the DC leakage current for all of the at least one electrically conductive mesh.

11. The method of claim 8 further comprising installing a separate lining wear detector in the lining wear detection circuit to detect the level of the DC leakage current for each separate one of the at least one electrically conductive mesh.

12. The method of claim 8 further comprises forming the at least one electrically conductive mesh from a cylindrically shaped electrically conductive mesh surrounding a height of the replaceable lining with a vertical gap between opposing vertical ends.

13. The method of claim 8 further comprises forming the at least one electrically conductive mesh from a cylindrically shaped electrically conductive mesh surrounding a height of the replaceable lining with overlapping opposing vertical ends separated by an electrical insulation.

14. The method of claim 8 further comprising forming the at least one electrically conductive mesh from an array of electrically conductive meshes surrounding a height of the replaceable lining, each one of the array of electrically conductive meshes electrically isolated from each other.

15. The method of claim 8 further comprising forming the at least one electrically conductive bottom mesh from a circular electrically conductive mesh having a radial gap between opposing radial ends.

16. The method of claim 8 further comprising forming the at least one electrically conductive bottom mesh from a circular electrically conductive mesh having overlapping radial ends separated by a bottom mesh electrical insulation.

17. The method of claim 8 further comprising forming the at least one electrically conductive bottom mesh from an array of electrically conductive bottom meshes with each one of the array of electrically conductive bottom meshes electrically isolated from each other.

18. The method of claim 8 further comprising installing a single bottom lining wear detector in the bottom lining wear detection circuit to detect the bottom lining level of the bottom lining DC leakage current for the at least one electrically conductive bottom mesh.

19. The method of claim 8 further comprising installing a separate bottom lining wear detector in the bottom lining wear detection circuit to detect the bottom lining level of the bottom lining DC leakage current for the at least one electrically conductive bottom mesh.

* * * * *